US006416363B1

(12) United States Patent
Sumiyoshi et al.

(10) Patent No.: US 6,416,363 B1
(45) Date of Patent: Jul. 9, 2002

(54) ELECTRICAL CONNECTOR AND METHOD OF MAKING SAME

(75) Inventors: Takeshi Sumiyoshi; Kenichi Hirokawa, both of Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/985,121

(22) Filed: Nov. 1, 2001

(30) Foreign Application Priority Data

Nov. 2, 2000 (JP) ..... 2000-335535

(51) Int. Cl.[7] ..... H01R 24/00
(52) U.S. Cl. ..... 439/676; 439/606
(58) Field of Search ..... 439/676, 606, 439/344

(56) References Cited

U.S. PATENT DOCUMENTS 4,231,628 A * 11/1980 Hughes ..... 439/676
4,269,467 A * 5/1981 Hughes ..... 439/344
5,094,631 A * 3/1992 Suzuki ..... 439/676
6,328,609 B1 * 12/2001 Ezawa et al. ..... 439/676

* cited by examiner

*Primary Examiner*—Tulsidas Patel
(74) *Attorney, Agent, or Firm*—Kanesaka & Takeuchi

(57) ABSTRACT

The terminals (21, 22) are supported by the housing (11) at the middle sections (21C, 22C). Each of the terminals (21, 22) has a contact section (21A, 22A) bent into the receiving cavity (12) of the housing (11) after integral molding with the housing (11).

5 Claims, 9 Drawing Sheets

FIG. 9 PRIOT ART

ELECTRICAL CONNECTOR AND METHOD OF MAKING SAME

BACKGROUND OF THE INVENTION

1. Field of the Invention

The present invention relates to an electrical connector and a method of making the same.

2. Description of the Related Art

A receptacle connector having a rectangular housing with a receiving cavity for receiving a mating plug connector so that the diagonally extending contact section is brought into spring contact with the terminal of the plug connector is well known.

FIG. 9 shows an example of such a receptacle connector disclosed in Japanese patent application Kokai No. 8-64288. This connector 50 comprises a shield case 51, a housing 52 having a receiving cavity 53 into which a mating plug connector (not shown) is inserted from above. A plurality of terminals 54 are provided in the connector 50 such that the contact sections 54A extend diagonally within the receiving cavity 53. A holding block 55 is provided in the connector 50 to hold the middle section of the terminals 54 such that the connection sections 54B project from the housing 52. As shown in FIG. 10, the holding block 55 is made separately from the housing 52 but molded integrally with the terminals 54, followed by forming the contact sections 54A by bending. The completed holding block 55 is inserted into the housing 52.

When the mating plug connector is inserted into the receiving cavity 53, the contact sections 54A are brought into spring contact with the terminal of the plug connector.

In the above connector, however, the housing 52 and the holding block 55 are molded separately, the terminals must be formed by bending prior to insertion of the holding block 55 into the housing 52 so that the manufacturing process is complicated, resulting in the increased manufacturing cost. Prior to the assembly, the number of parts is too many to manage easily.

SUMMARY OF THE INVENTION

Accordingly, it is an object of the invention to provide an electrical connector capable of being made by a simple process at a low cost and a method of making the connector.

According to the invention there is provided an electrical connector comprising a housing having a receiving cavity for receiving a mating connector; a plurality of terminals arranged in the housing at predetermined intervals; each of the terminals made by bending a metal strip so as to provide a middle section supported by the housing, a flexible contact section extending diagonally into the receiving cavity, and a connection section projecting from the housing; the middle sections being supported by the housing by integral molding; and the receiving cavity being made sufficiently large to bend the contact sections in the receiving cavity.

According to the invention, the middle sections of the terminals are supported by the housing by the integral molding, and the receiving cavity is sufficiently large to bend an end of each of the terminals into the receiving cavity.

According to another aspect of the invention there is provided a method of making the electrical connector, which comprises the steps of providing a plurality of terminals/carrier materials in which the terminals are connected at opposite ends by the carriers; integrally molding the housing and the terminal/carrier materials; cutting off the carrier to provide the individual terminals; and bending an end of each of the individual terminals into the receiving cavity.

According to an embodiment of the invention, the housing is provided with a through-hole at a position corresponding to the middle sections of the terminals such that a holding mold supports the terminals in the through-hole to thereby keep the precise positions of the terminals.

According to another embodiment, each of the terminals is provided with a lateral projection within the through-hole so that the holding mold supports the extended sections including the lateral projection for secured holding.

The terminals are arranged in a plurality of tiers such that the lateral projections are offset in different tires so that it is possible to make an integral molding despite the multiple tier arrangement of the terminals.

DESCRIPTION OF THE PREFERRED EMBODIMENTS

Embodiments of the invention will now be described with reference to FIGS. 1–8.

Figure 1:
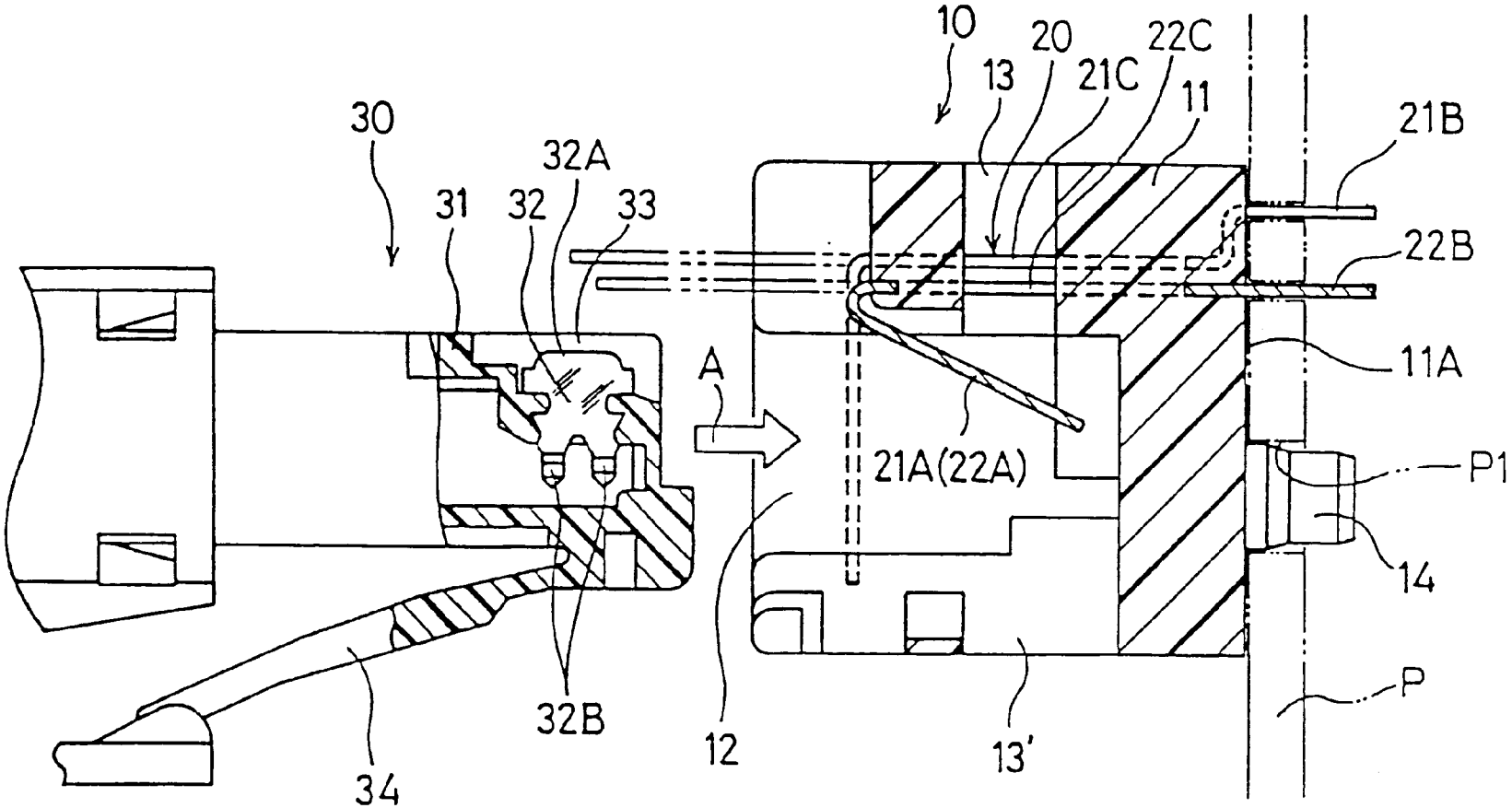
FIG. 1 is a sectional view of an electrical connector according to an embodiment of the invention.
Figure 3:
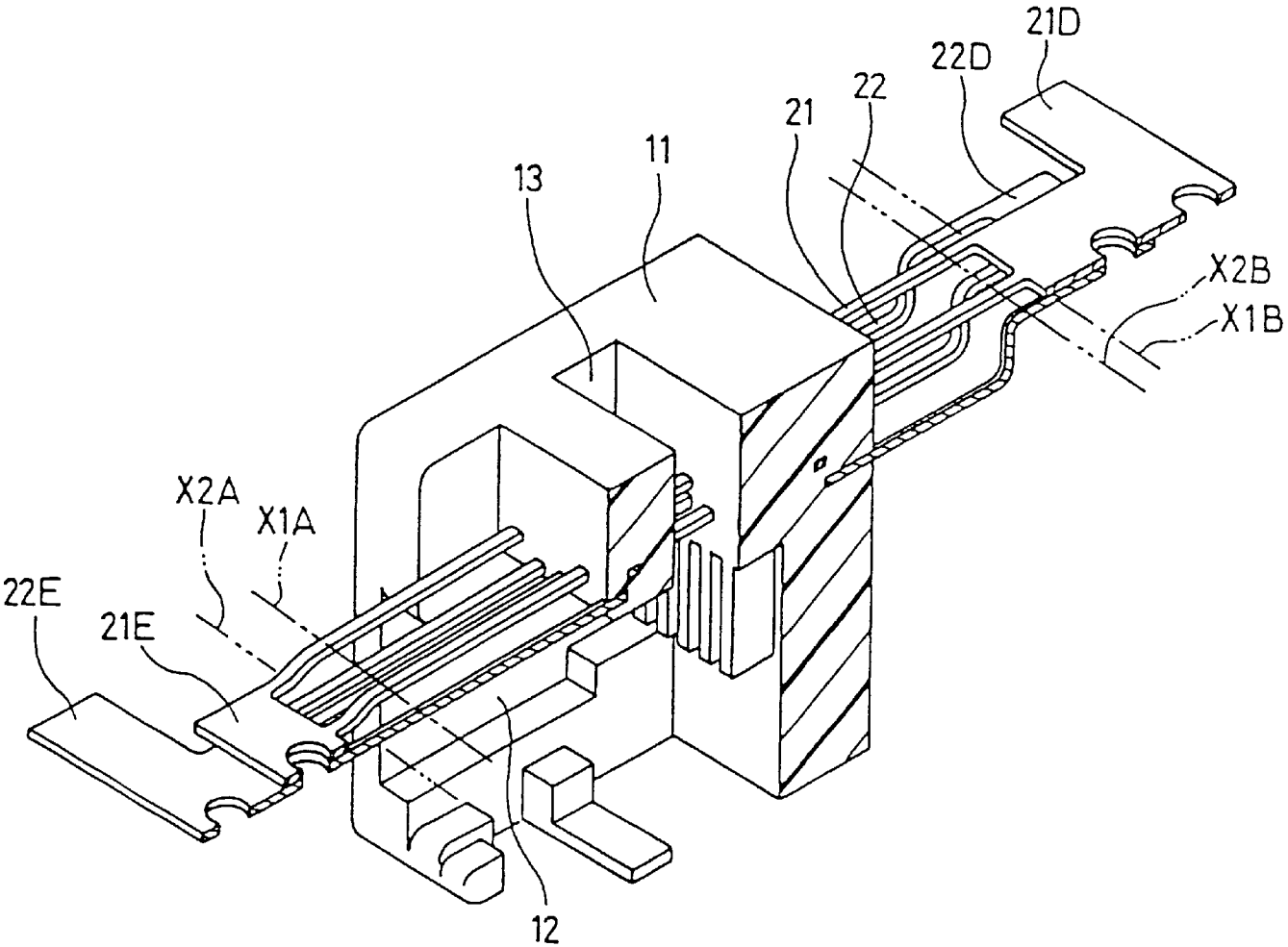
FIGS. 3 and 4 are perspective and sectional views of the terminals after the molding but prior to cut off of carriers, respectively.

In FIG. 1, a receptacle connector 10 comprises a housing 11 with a receiving cavity 12 for receiving a plug connector 30 in the direction of an arrow A. A plurality of terminals 20 are supported by the housing 11 that is made of an insulative material. As shown in FIGS. 1 and 3, the housing 11 is molded integrally with the terminals 20 such that the receiving cavity has a front opening (to the left in the figure) and a lower opening. A through-hole 13 is provided in the upper wall of the housing 11 which holds the terminals such that an attaching leg 14 extend rearwardly from the rear face 11A of the housing 11 for insertion into an attaching hole P1 of a circuit board P.

Figure 2:
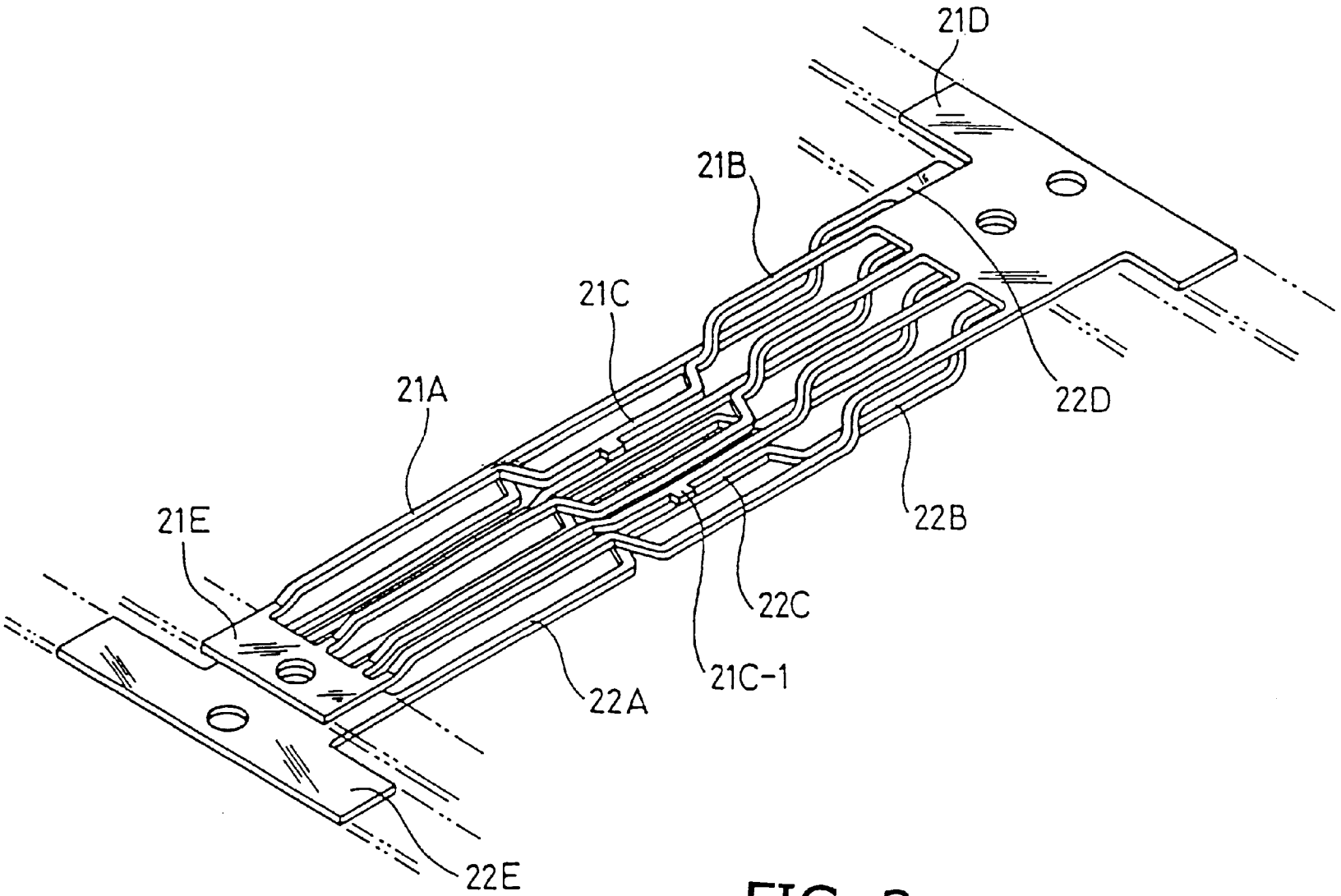
FIG. 2 is a perspective view of terminals prior to the molding of a housing.

The terminals 20, which are held by the housing 11, are arranged in two tiers. The upper or lower terminals 21 or 22 has a flexible contact section 21A or 22A, a connection section 21B or 22B to be soldered to a circuit board P, a middle section 21C or 22C between them. As shown in FIG. 2, the upper terminal 21 extends diagonally in the direction of terminal arrangement from the straight contact section 21A, to the straight middle section 21C, and again diagonally to the connection section 21B. The lower terminal 22 is bent in the opposite direction to the upper terminal 21.

Referring back to FIG. 1, the contact sections 21A and 22A are formed by bending the straight sections indicated by dotted lines through broken lines to the diagonal sections indicated by the solid lines. The receiving cavity 12 is made sufficiently large to allow such formation of the contact sections 21A and 22A.

Figure 4:
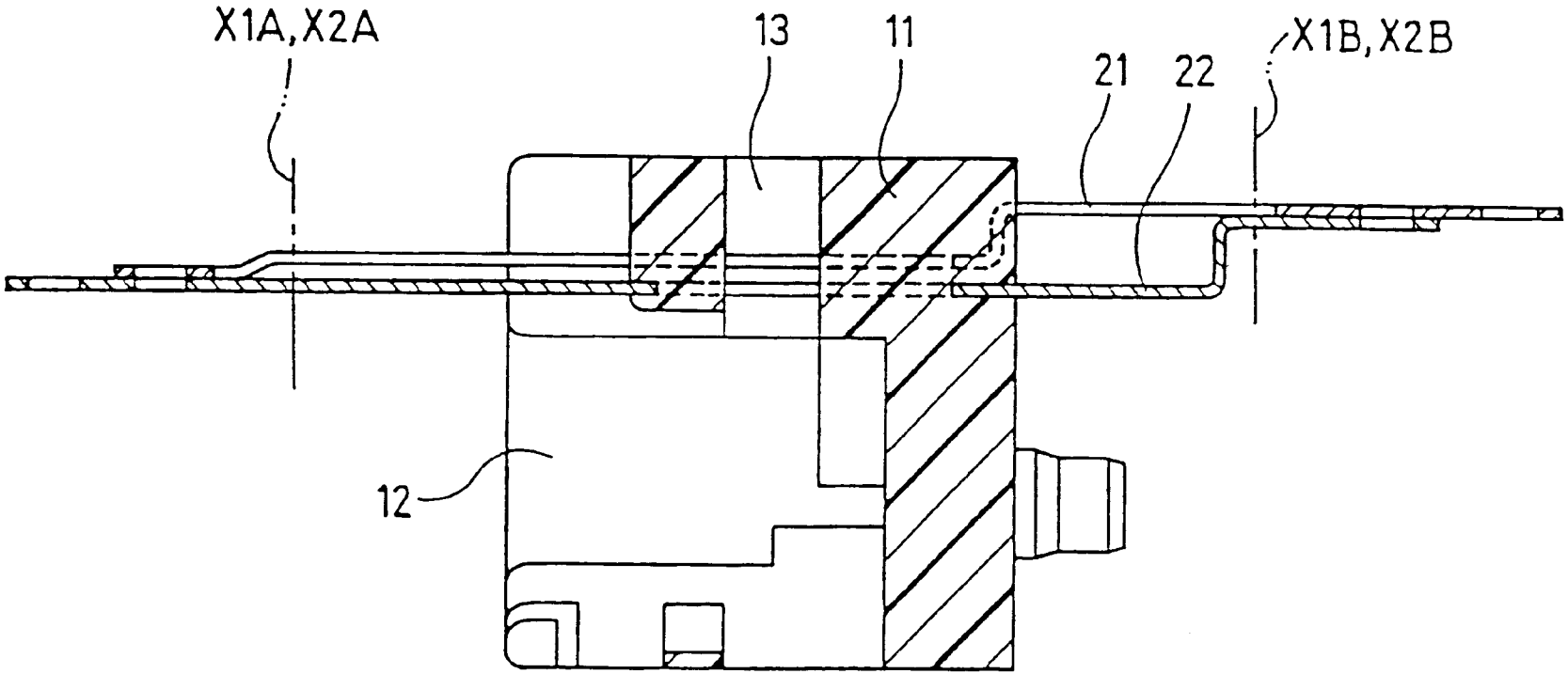

In FIGS. 3 and 4, the terminals 21 and 22 are connected at opposite ends to carriers 21D and 21E, and 22D and 22E, respectively. The terminals 21 and 22 are molded integrally with the housing 11 such that a set of four terminals are grouped in each tier. During the molding process, the middle sections 21C and 22C of the terminals 21 and 22 are held by the upper and lower holding molds that are inserted through the through-hole 13.

Figure 5A:
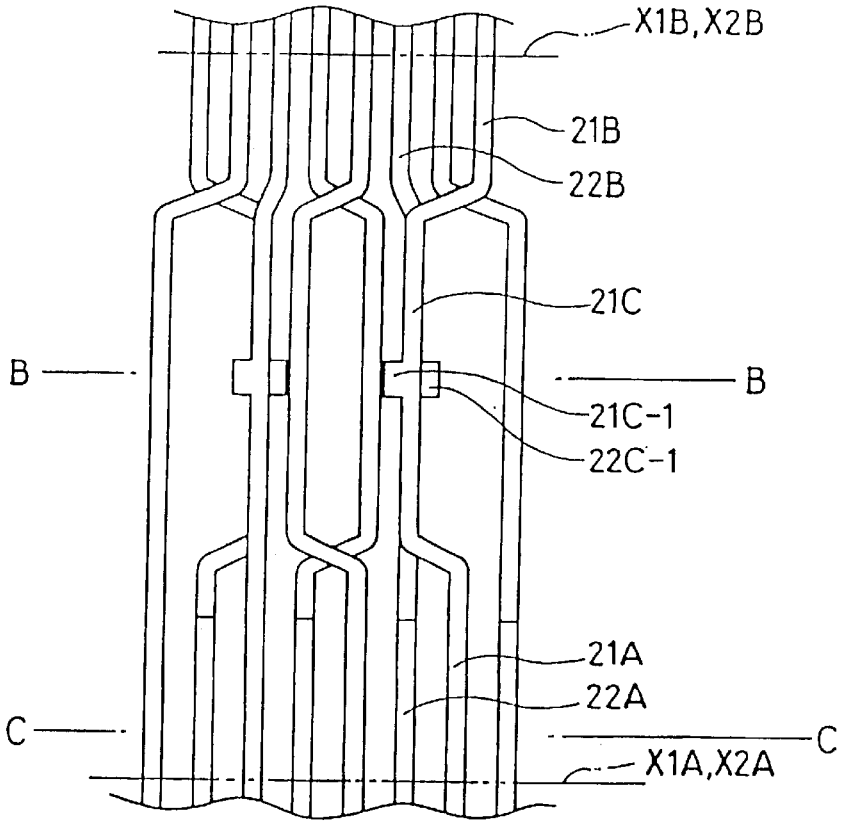
FIG. 5(A) is a plan view of the terminals.
Figure 5B:
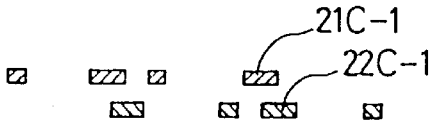
FIGS. 5(B) and (C) are sectional views taken along lines B—B and C—C of FIG. 5(A), respectively.
Figure 5C:
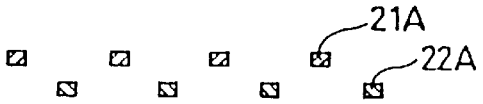
Figure 6:
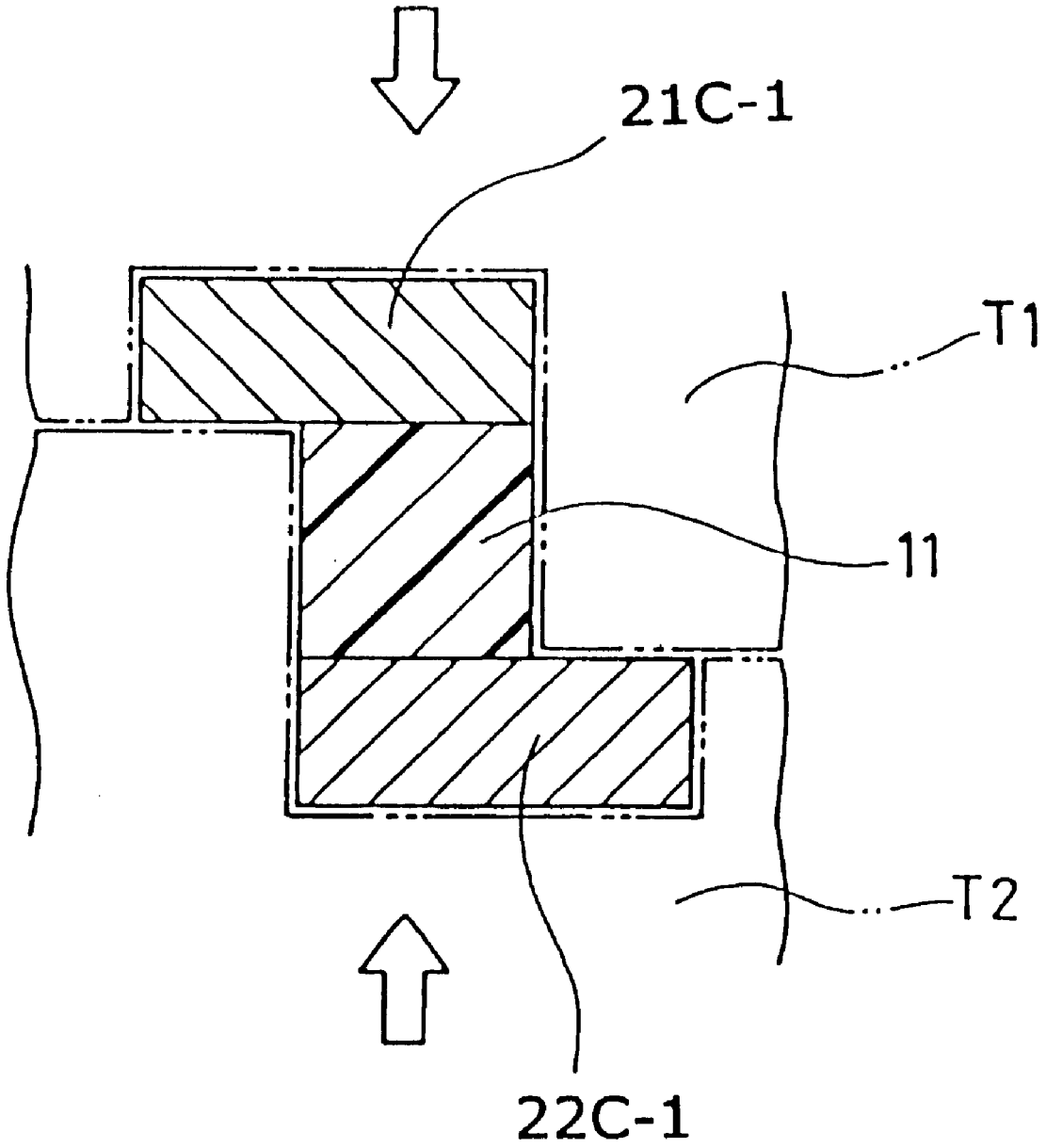
FIG. 6 is a sectional view of the middle sections of terminals.

The above two sets of terminals 21 and 22 are bent laterally and vertically such that the contact sections 21A and 22A are spaced at predetermined lateral and vertical intervals and the middle sections 21C and 22C are supported by the holder mold without difficulty. As shown in FIG. 5(A), a lateral projection 21C-1 or 22C-1 extends from the middle section 21C or 22C in the arranging direction opposite to each other. The arrangement of the terminals are shown in section at different positions in FIGS. 5(B) and (C), respectively. As shown in FIG. 6, a set of holding molds T1 and T2 holds the middle sections 21C and 22C from above and bottom. Since the lateral projections 21C-1 and 22C-1 extend in the opposite directions, it is assured that the holding molds T1 and T2 hold the middle section 21C and 22C (lateral projections 21C-1 and 22C-1) between them from above and bottom. A mold flows into a space between the holding molds T1 and T2 to form a part of the housing 11.

Thus, the terminals 21 and 22 with the carriers are held by the housing 11 as shown in FIG. 3. Since the middle sections are held by the holding molds T1 and T2 from above and bottom, they do not move during the mold process to assure accurate determination of the distance between the terminals. Then, the carriers 21E and 21D are cut off at dotted lines X1A and X1B, and X2A and X2B, respectively, and the contact sections 21A and 22A are bent to provide the complete connector 10 as shown in FIG. 1.

In FIG. 1, a mating plug connector 30 comprising a housing 31 and a plurality of terminals 32 held in the housing 31. A plurality of channels 33 are provided in the housing 31 at positions corresponding to the terminals 21 and 22 for guiding the contact sections 21A and 22A of the terminals 21 and 22. When the plug connector 30 is inserted into the receiving cavity 12 of the receptacle connector 10, the contact sections 21A and 22A are guided into the channels 33 and brought into spring contact with the contact sections 32A of the terminals 32. Each of the terminals 32 has a connection blade 32B, which pierces the insulation of a cable for connection with the core wire. A lock release lever 34 extends rearwardly from the bottom of the plug connector 30. By squeezing the release lever 30, the engagement between the connectors 10 and 30 is released.

Figure 7:
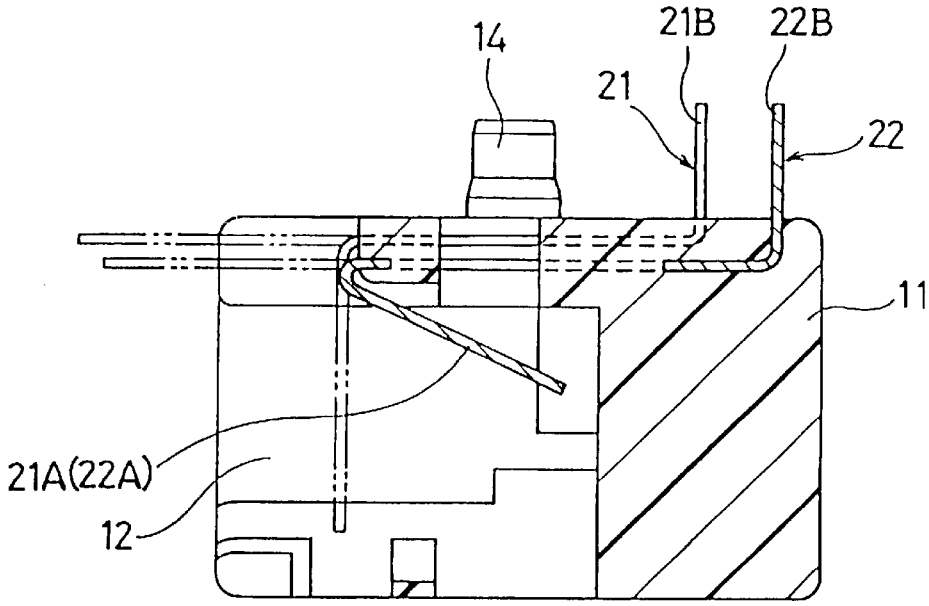
FIG. 7 is a sectional view of an electrical connector according to another embodiment of the invention.

In FIG. 7, an attaching arm 14 extends upwardly from the top of the housing 11, and the connection sections 21B and 22B of terminals 21 and 22 project upwardly from the top of the housing 11. The upward bending of the connection sections 21B and 22B is made prior to the molding of the housing 11.

Figure 8:
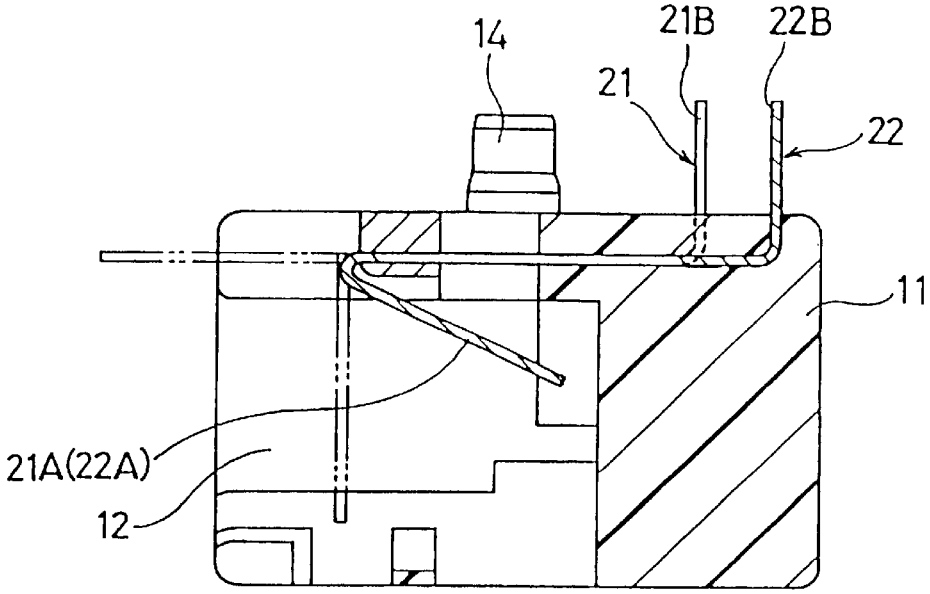
FIG. 8 is a sectional view of an electrical connector according to still another embodiment of the invention.
Figure 9:
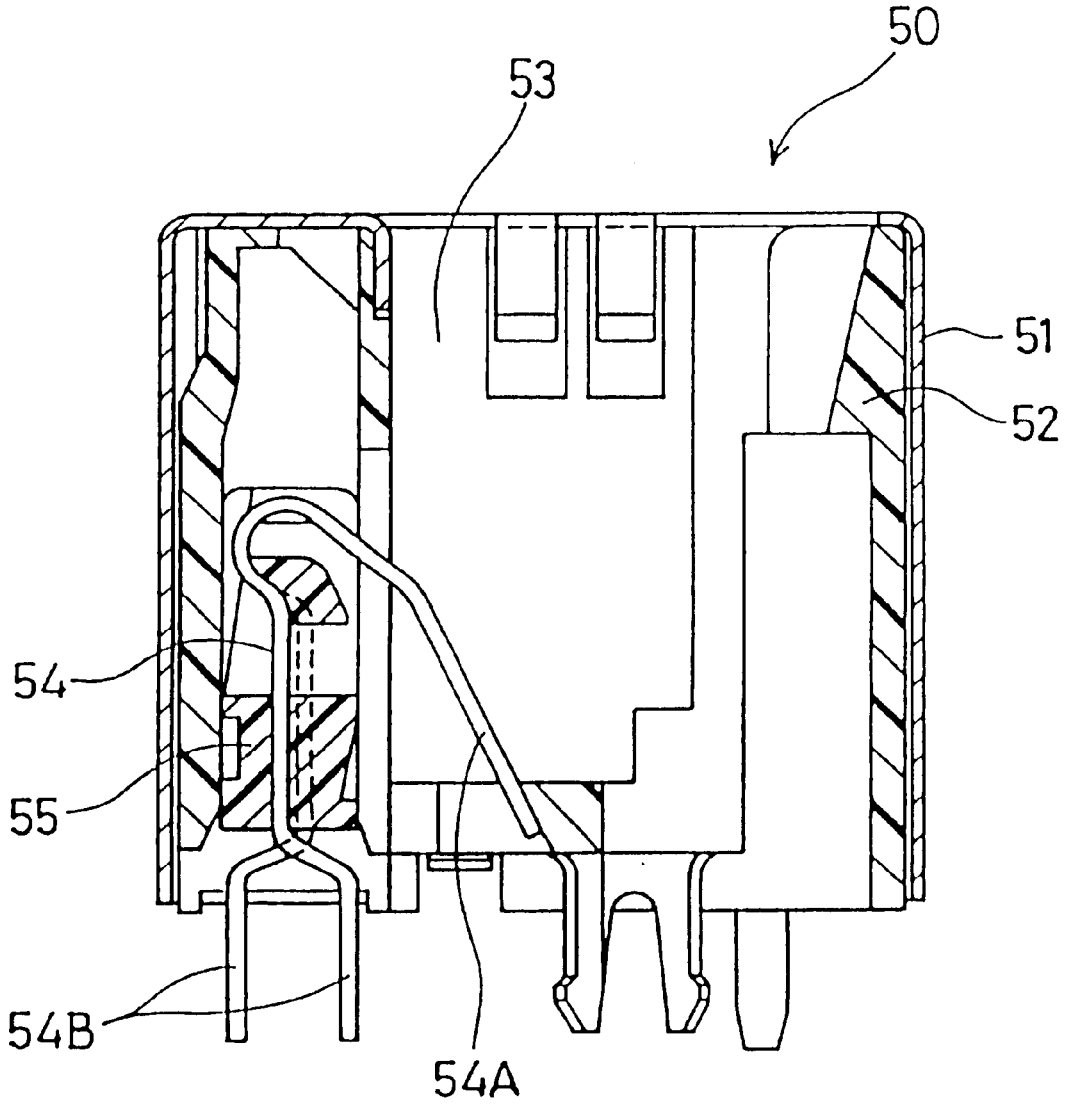
FIG. 9 is a sectional view of a conventional electrical connector.
Figure 10:
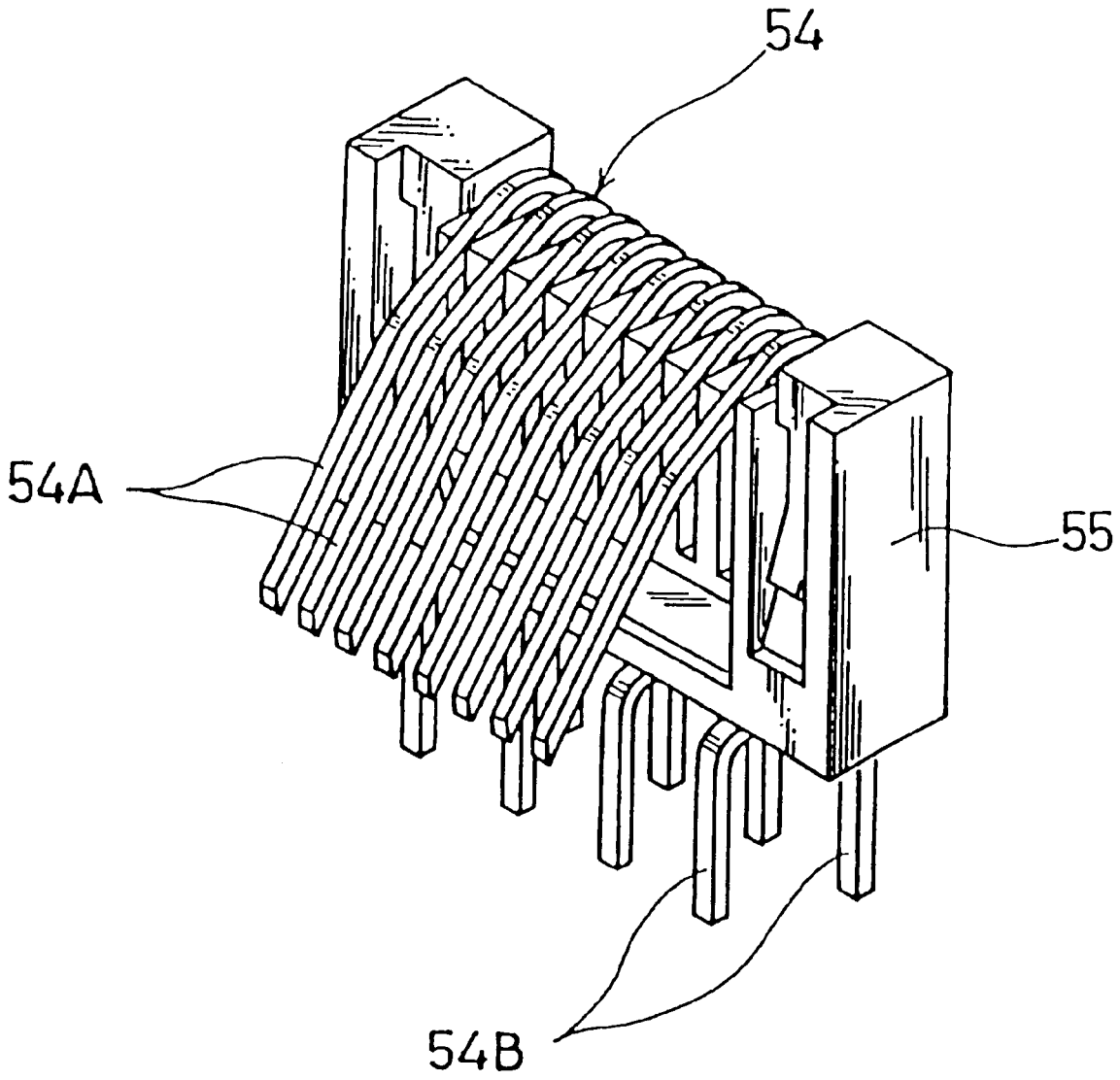
FIG. 10 PRIOR ART
FIG. 10 is a perspective view of a terminal block for the conventional connector.

In FIG. 8, the terminals 21 and 22, which are arranged in two tires in FIG. 7, are arranged in a single level, and only the connection sections 21B and 22B are offset according to the connection positions of the circuit board.

As has been described above, according to the invention, the terminals are molded integrally with the housing as a unit and then bent once to provide an integral connector so that the manufacturing process is very simple, resulting in the reduced manufacturing cost. Since the terminals are molded integrally with the housing, they are retained securely, and the positioning between the terminals is very precise due to the high precision of the molds.

What is claimed is:

1. An electrical connector comprising:

a housing having a receiving cavity for receiving a mating connector;

a plurality of terminals arranged in said housing at predetermined intervals;

each of said terminals made by bending a metal strip so as to provide a flexible contact section extending diagonally into said receiving cavity, a connection section projecting from said housing, and a middle section supported by said housing by integral molding, wherein said terminals are press-held by holding molds at positions other than said flexible sections during said integral molding;

said receiving cavity being made sufficiently large to bend said contact sections in said receiving cavity.

2. The electrical connector according to claim 1, wherein said housing is provided with a through-hole at a position corresponding to said middle sections of said terminals so that said holding molds press-hold said terminals in said through-hole.

3. A method of making the electrical connector according to claim 1, said method comprising the steps of:

providing a plurality of terminal materials in which said terminals are connected at opposite ends by carriers;

press-hold said terminal materials at said positions other than said flexible sections by said holding molds;

integrally molding said housing and said terminal materials;

cutting off said carrier to provide said individual terminals; and bending an end of each of said individual terminals into said receiving cavity.

4. An electrical connector comprising:

a housing having a receiving cavity for receiving a mating connector;

a plurality of terminals arranged in said housing at predetermined intervals;

each of said terminals made by bending a metal strip so as to provide a middle section supported by said housing, a flexible contact section extending diagonally into said receiving cavity, and a connection section projecting from said housing;

said middle sections being supported by said housing by integral molding; and said receiving cavity being made sufficiently large to bend said contact sections in said receiving cavity, wherein said housing is provided with a through-hole at a position corresponding to said middle sections of said terminals so that a holding mold supports said terminals in said through-hole and said each of said terminals is provided a lateral projection within said through-hole.

5. The electrical connector according to claim 4, wherein said terminals are arranged in a plurality of tiers such that said lateral projections are offset in different tiers.

* * * * *